US006705649B1

(12) United States Patent
Reddmann

(10) Patent No.: US 6,705,649 B1
(45) Date of Patent: Mar. 16, 2004

(54) DOOR LOCK FOR A MOTOR VEHICLE

(75) Inventor: Uwe Reddmann, Essen (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 09/937,959

(22) PCT Filed: Jul. 12, 2000

(86) PCT No.: PCT/EP00/06579

§ 371 (c)(1),
(2), (4) Date: Sep. 28, 2001

(87) PCT Pub. No.: WO01/07735

PCT Pub. Date: Feb. 1, 2001

(30) Foreign Application Priority Data

Jul. 23, 1999 (DE) ..... 199 34 128

(51) Int. Cl.[7] ..... E05C 3/06
(52) U.S. Cl. ..... 292/216; 292/201; 292/DIG. 23
(58) Field of Search ..... 292/201, 216, 292/DIG. 23

(56) References Cited

U.S. PATENT DOCUMENTS

| | | | | | |
|---|---|---|---|---|---|
| 4,440,006 | A | * | 4/1984 | Kleefeldt | 292/DIG. 23 |
| 4,974,886 | A | * | 12/1990 | Kleefeldt et al. | 292/201 |
| 4,988,135 | A | * | 1/1991 | Ottino | 292/201 |
| 5,066,054 | A | * | 11/1991 | Ingenhoven | 292/201 |
| 5,238,274 | A | * | 8/1993 | Becker et al. | 292/201 |
| 5,437,173 | A | * | 8/1995 | Spinar | 70/89 |
| 5,474,338 | A | | 12/1995 | Büscher | |
| 5,494,322 | A | * | 2/1996 | Menke | 292/216 |
| 5,615,564 | A | * | 4/1997 | Inoue | 70/279.1 |
| 5,667,260 | A | * | 9/1997 | Weyerstall | 292/201 |
| 5,673,578 | A | * | 10/1997 | Roos | 292/201 |
| 5,833,282 | A | * | 11/1998 | Ikeda | 292/201 |
| 5,921,595 | A | * | 7/1999 | Brackmann et al. | 292/201 |
| 6,048,002 | A | * | 4/2000 | Ohta et al. | 292/201 |
| 6,056,334 | A | * | 5/2000 | Petzold et al. | 292/216 |
| 6,082,158 | A | * | 7/2000 | Wegner | 70/277 |
| 6,109,079 | A | * | 8/2000 | Ikeda | 70/264 |
| 6,109,674 | A | * | 8/2000 | Bartel et al. | 292/201 |
| 6,148,651 | A | * | 11/2000 | Roncin | 70/264 |
| 6,338,508 | B1 | * | 1/2002 | Kleefeldt | 292/201 |
| 6,343,817 | B1 | * | 2/2002 | Watanabe | 292/216 |
| 6,390,517 | B1 | * | 5/2002 | Ehret | 292/201 |
| 2002/0056996 | A1 | * | 5/2002 | Fukunaga et al. | 292/216 |

FOREIGN PATENT DOCUMENTS

| | | |
|---|---|---|
| DE | 43 34 522 | 1/1995 |
| DE | 195 33 199 | 3/1997 |
| DE | 19650826 | 6/1998 |

* cited by examiner

*Primary Examiner*—J. J. Swann
*Assistant Examiner*—Thomas Ho
(74) *Attorney, Agent, or Firm*—Herbert Dubno; Andrew Wilford

(57) ABSTRACT

The invention relates to a door lock for a motor vehicle. The principal design of the inventive door lock comprises a rotary lock (1), a lock pawl (2) an actuation lever system (3), a latching lever system (5) and a central locking drive (10*a*, 10*b*, 11) for a central locking element (8). The central locking element (8) comprises, in addition to the first forked arm (13), at least one second forked arm (14). Both forked arms (13, 14) project at least partially into the arc of rotation of an eccentric control pin (12) of the central locking drive (10*a*, 10*b*).

8 Claims, 3 Drawing Sheets

DOOR LOCK FOR A MOTOR VEHICLE

CROSS REFERENCE TO RELATED APPLICATIONS

This application is the US national phase of PCT application PCT/EP00/06579 filed Jul. 12, 2000 with a claim to the priority of German patent application 19934128.1 itself filed Jul. 23, 1999.

FIELD OF THE INVENTION

The invention relates to a motor-vehicle door latch having a pivotal latch member and pawl, and a lever actuating system and a latching-lever system, and a central-locking drive for a central-locking element, the central-locking drive has at least one eccentric control pin which moves along an arcuate path and that can engage in a first fork seat of the central-locking element to establish "unlocked" and "locked" positions and where the control pin is also movable into an "antitheft" position. The lever locking system normally comprises an outside latching mechanism and an inside latching mechanism. The outside latching mechanism is typically provided with a locking cylinder and locking nut. The inside latching mechanism has at least an inside latching lever. The actuating lever system comprises in general an outside door handle and an inside door handle.

With a motor-vehicle door latch of the above-described type an additional coupling lever is provided which connects a latching lever with the actuating lever system. In the "antitheft" position the control pin blocks the coupling lever via an additional antitheft element on the coupling lever. Such a system is fairly effective, but is somewhat expensive to manufacture due to the described separate antitheft element (see DE 195 33 199).

In a similar system a Y-shaped cutout is provided in the central-locking element. Inside this cutout are control surfaces against which engages a control pin so as to in this manner pivot the central-locking element. In the antitheft position, as shown there in FIG. 1, the central-locking element is also arrested by means of the known central-locking drive. Thereafter a mechanical unlocking is not actually possible (see U.S. Pat. No. 5,240,296).

The invention is aimed at the technical problem of so improving a motor-vehicle door latch of the above-described construction that flawless operation is obtained with the fewest possible parts.

This object is achieved according to the invention in that, starting from a motor-vehicle door latch of the above-described type, the central-locking element also has in addition to the first fork seat a second fork seat, these two fork seats extending partially into the arcuate path of the control pin. According to a preferred embodiment, the two fork seats are formed on a common arc of an arcuate segment of the central-locking element. Overall, the two fork seats form four control surfaces in order to be able to follow the following commands:

a) lock;

b) unlock (from the "locked" position);

c) antitheft; and d) unlock (from the "antitheft" position).

Of course there can be more than four control surfaces when there is a third fork seat.

The central-locking element can have a central-locking pin that assumes together with the central-locking element the "unlocked," "locked," and "antitheft" positions. Finally the central-locking element is pivoted by the central-locking drive into the three identified positions. At the same time these positions are retained in that the central-locking element in the "unlocked," "locked," and "antitheft" positions is arrested by end abutments in the housing and/or by catches.

Preferably the latching-lever system has the above-mentioned inside latching lever cooperating with the central-locking element in the "unlocked" and "locked" positions. In other words, the "antitheft" position is when the inside latching lever and the central-locking element, as is usual, are not connected with each other, some coupling between them being disconnected. This is made possible in that the inside latching lever has an unlocking formation and a locking formation. Here the unlocking formation is effective on the central-locking pin for unlocking and the locking formation on the central-locking pin for locking. Both the unlocking formation and the locking formation move on pivoting of the inside latching lever through respective arcs about an axis of the inside latching lever.

The central-locking pin also describes on pivoting of the central-locking element about its axis an arc, namely the pin arc. The relative positions of the central-locking pin and the locking and unlocking formations are such that the arcuate travel paths of the formations and of the pin intersect when, and only when, in the locked and unlocked positions. However, when in the "antitheft" position the arcuate paths of the formations are spaced from the central-locking pin so that there can be no contact between the central-locking element and the inside latching lever in this position. As a result, when the inside latching lever pivots it has no effect on the central-locking element.

In addition the axis of the central-locking element and the axis of the inside latching lever are as a rule parallel to each other, both parts (that is the central-locking element and the inside latching lever) lying in separate planes and partially overlapping each other so that the desired interaction and thus intersection of the pin arc and the formation arcs are possible only for locking and unlocking.

According to the invention the antitheft element according to German 195 33 199 as well as the inside-locking button can be dispensed with. In other words the inside latching lever takes over both of these functions. This is made possible in that the inside latching lever is moved after each actuation by a spring into its rest position. In addition the inside latching lever is usually connected via an actuating rod or Bowden cable with an inside door handle so that locking or unlocking of the motor-vehicle latch requires a double actuation of the inside door handle. During a first actuation of the two-stroke inside actuation the latch—starting from the "locked" position—is unlocked. During the second stroke of the inside handle the door latch is actually opened, in fact in the same direction. This is more fully described with reference to the description and drawing.

Overall with the illustrated motor-vehicle door latch the three positions, "unlocked," "locked," and "antitheft," are established in an extremely simple mechanical way. Furthermore only one drive, namely the central-locking drive, is needed so that a prior-art separate antitheft drive is unnecessary. This is also true with the required antitheft lever of German 195 33 199. The mechanics only require very few parts as a result of two fork seats on the central-locking element defining four control surfaces. The described connection between the inside latching lever and the central-locking lever serves only for locking and unlocking so that as required in U.S. Pat. No. 5,240,296 blocking the central-locking element in the antitheft position is unnecessary. Finally the described motor-vehicle door latch can be opened in the "antitheft" position (from outside) by a locking cylinder with a locking nut. This ensures that in this position it is impossible—even if the window is broken—to open the actual door because the inside door handle is disconnected. These are the main advantages of the invention.

In the following the invention is more closely described with reference to only one embodiment shown in a drawing. Therein:

Figure 3:
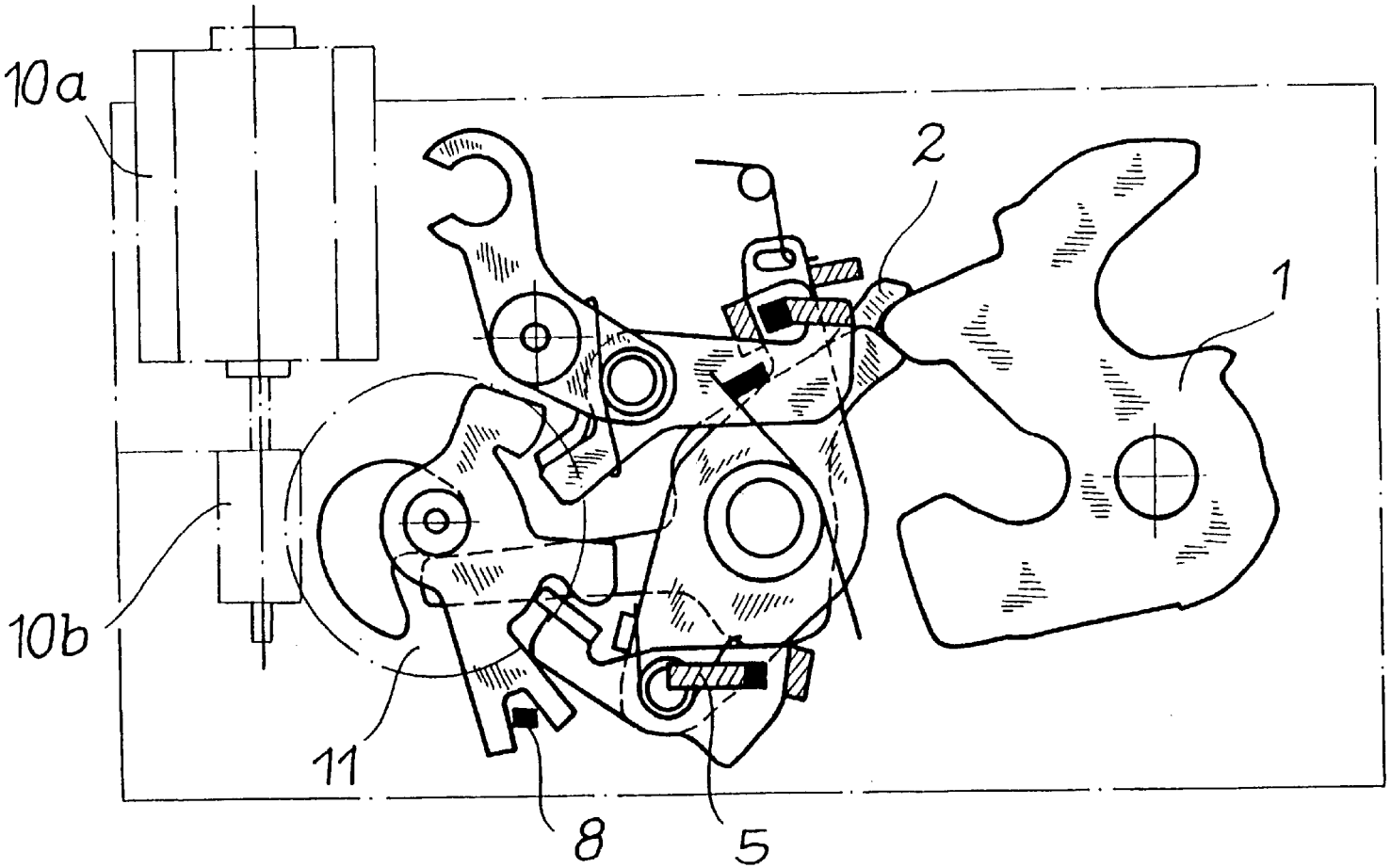
FIG. 3 is the lock mechanism of the motor-vehicle door latch according to FIG. 1 which extends at a right angle to the elements shown in FIG. 1.

The figures show a motor-vehicle door latch which as is standard and as shown in FIG. 3 has a pivotal latch element 1 with a latching pawl 2. In this embodiment the latching pawl is operated by an electric motor as described basically in German patent application 196 50 826 to which express reference is made. Of course it is possible to use instead a purely mechanically released latching pawl.

In addition the basic system has an actuating lever system which primarily comprises an inside door handle 3 connected to an actuating rod 4 or actuating Bowden cable. This actuating rod 4 or Bowden connects the inside door handle 3 to an inside latching lever 5 or to a pin 6 on it. In addition to the illustrated inside door handle 3 there can also be an unillustrated outside door handle.

The inside latching lever 5 belongs to a latching lever system which also has an unillustrated lock cylinder with locking nut 7. This locking nut 7 is operated directly by the lock cylinder or a key inserted into it. Rotation of the locking nut 7 is converted directly to pivoting of a central-locking element 8, here a central-locking lever 8. This happens in that the locking nut 7 and locking element lever 8 have meshing teeth 9. As a result the central-locking lever 8 can at any time depending on position be locked or unlocked by the outside lock system, that is the locking nut 7, because it (the central-locking lever 8) is in continuous engagement by means of the teeth 9 with the locking nut 7.

In addition there is a central-locking drive 10*a*, 10*b*, 11 with a motor 10*a* and output shaft 10*b* that acts via an output wheel 11 with an eccentric control pin 12 on the central-locking element 8. Operation of the motor 10*a* or of the central-locking drive 10*a*, 10*b*, 11 moves the control pin 12 through an arc that is shown by a double-headed arrow in FIG. 1. In this manner the control pin 12 engages in fork seats 13 and 14 of the central-locking lever 8. These fork seats 13 and 14 comprise a first fork seat 13 and a second fork seat 14 that both are arranged on a common arc R of an arcuate segment 8*a* of the central-locking lever 8. This common arc R is shown in dot-dash lines in FIG. 1.

The two fork seats 13 and 14 together form four control surfaces shown at a), b), c), and d) for the control pin 12. These control surfaces a) through d) control the following respective actions:

a) locking;

b) unlocking (from the "locked" position)

c) antitheft mode on; and d) unlocking (from the "antitheft" position).

In any case both fork seats 13 and 14 open at least partially on the illustrated arcuate path of the control pin 12 such that the above-mentioned four control surfaces a) through d) can in the described manner be operated by the control pin 12.

Figure 2:
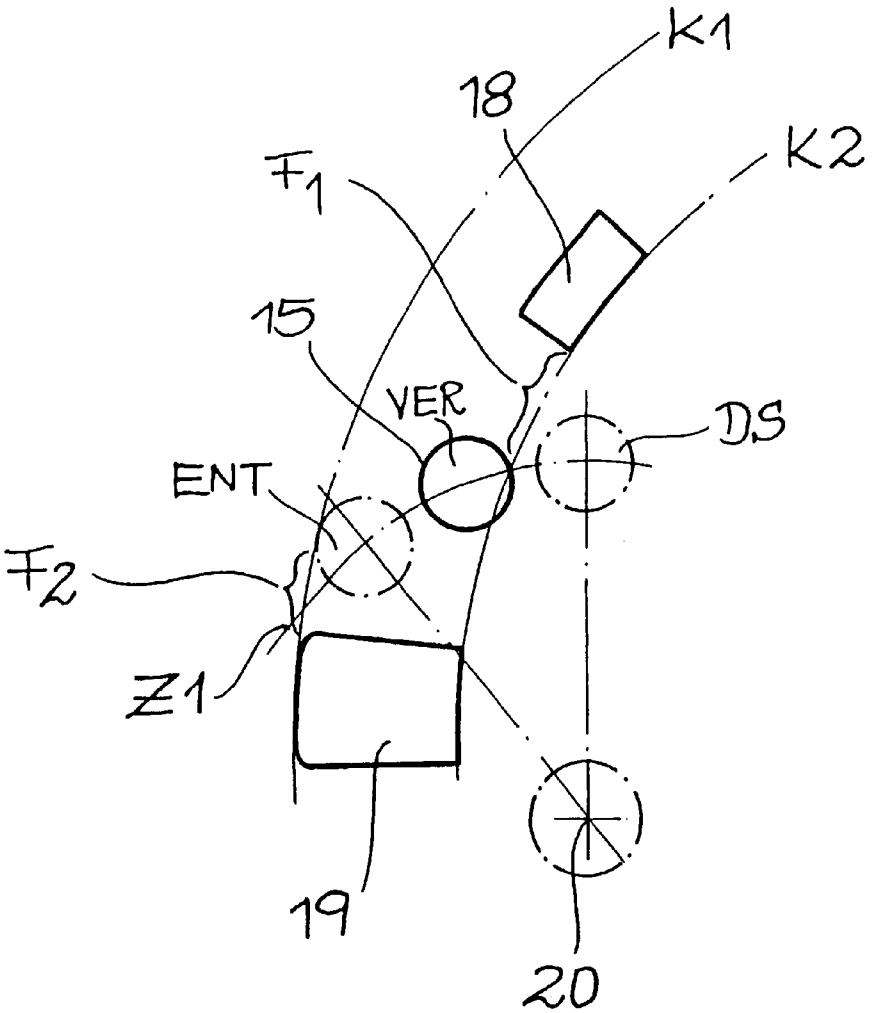
FIG. 2 is an enlarged detail of FIG. 1 in the region of the central-locking pin.

The overall effect is that the central-locking element or lever 8 can assume the "unlocked," "locked," and "antitheft" positions as shown in detail particularly well in FIG. 2. The same is true for a central-locking pin 15 fixed on the central-locking element 8 and shown enlarged in this illustration and movable through an arc Z1 about an axis 20. The end position of the pin on the left corresponds to the "unlocked" position ENT, while the end position on the right corresponds to the "antitheft" position DS. The central position of the central-locking pin 15 on the other hand is the "locked" position VER. In order that these positions of the central-locking pin 15 and thus of the central-locking lever 8 can be assumed accurately, end abutments are provided in the housing. According to the illustrated embodiment the central-locking lever 8 has a latching seat 16 which fits with a catch element 17 on or in the housing for corresponding retaining of the central-locking lever 8.

Finally there is still an unlocking formation 18 as well as a locking formation 19 on the inside latching lever 5 which engage as described below with the central-locking pin 15. The unlocking formation 18 and the locking formation 19 move in arcs also, so-called formation arcs K1 and K2 about an axis 21 (see FIG. 2). The pin arc Z1 and the respective formation arcs K1 and K2 intersect to unlock and unlock (that is in positions ENT and VER of the central-locking pin 15), while in the antitheft position DS the formation arcs K1 and K2 are offset from the above-mentioned pin 15.

Figure 1:
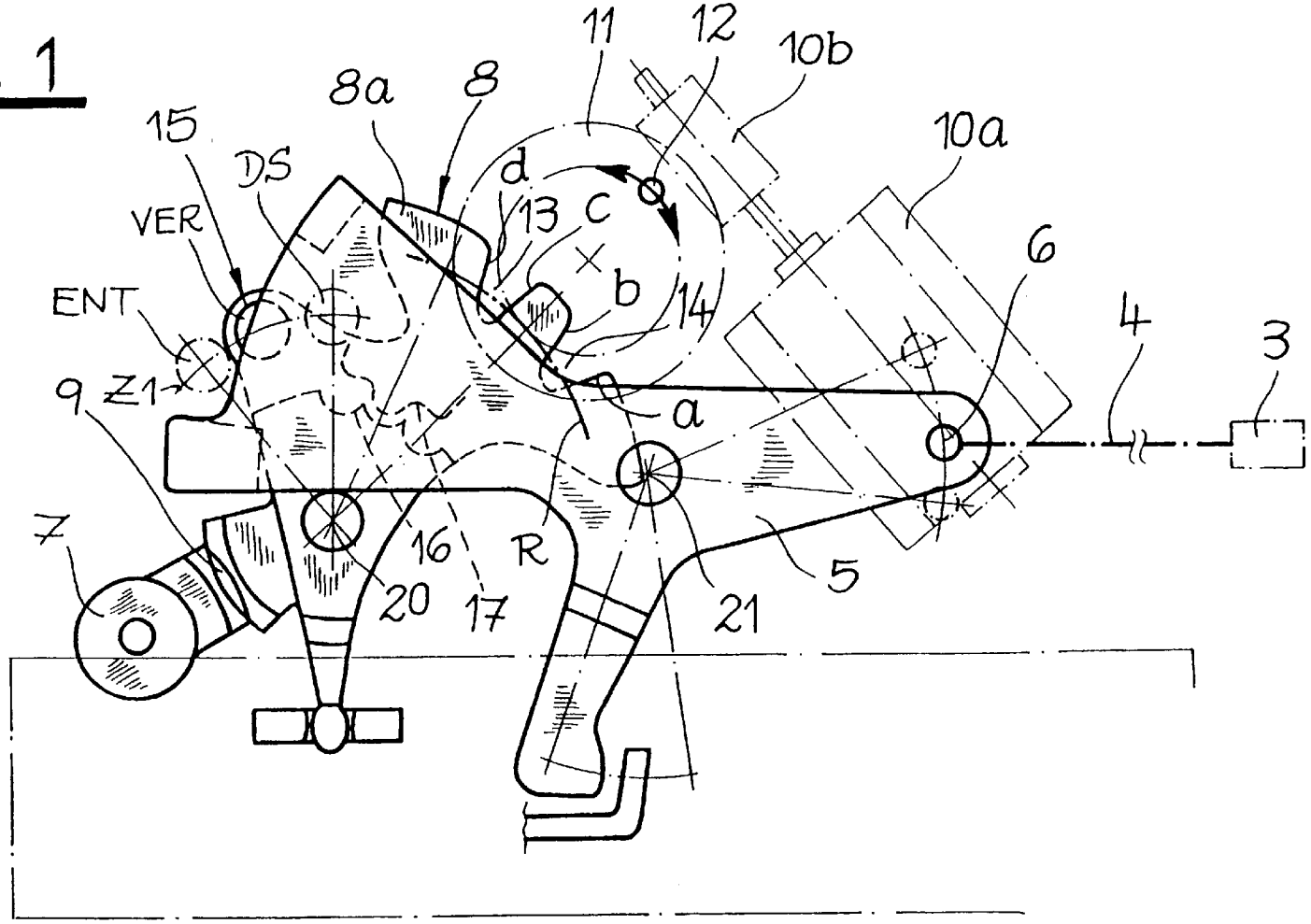
FIG. 1 is a motor-vehicle door latch with a central-locking element and an inside latching lever.

The system operates as follows: In FIG. 1 the parts are shown in the "locked" position. As already described by means of the outside latching mechanism and the locking nut 7 it is possible to unlatch (and even to move out of the "antitheft" position) regardless of position. Independently of course the central-locking lever 8 can be moved by the central-locking drive 10 with the control pin 12 into. the described positions a) through d) when the control pin 12 is moved along its arc and engages the corresponding control surfaces.

In general this control pin 12 of the output wheel 11 is stopped after each actuation in the starting position shown in FIG. 1. This end position can for example be confirmed by an unillustrated switch engaging the output wheel 11. In any case the control pin 12 moves from the starting position of FIG. 1 after about a half revolution independently of rotation direction (of the reversible motor 10*a*) in seat 13 or seat 14 and engages against one of the control surfaces, for example surface either c) or b) or a) or d). In this manner the central-locking lever 8 is pivoted to take the necessary position.

In order to be able to lock and unlock via the inside door handle 3, the two axes 20 and 21 of the central-locking lever 8 and of the inside latching lever 5 are arranged parallel to each other. In addition the two levers 5 and 8 are set to overlap in respective planes as visible in FIG. 1. In this embodiment the inside latching lever 5 is above the central-locking lever 8 although an opposite orientation is possible. In any case an actuation of the inside door handle 3 is effective via the actuating rod 34 to move the inside latching lever 5—starting from the locked position shown in FIG. 1—counterclockwise to unlock or open as shown in the dashed-line position of the pin 6. This first actuation of the inside door handle 3 corresponds to a no-load stroke or movement of the latch mechanism shown in FIG. 3. It moves the unlocking formation 18 first relative to the central-locking pin 15 through a path $F_1$. Thereafter on moving beyond the free path $F_1$ the unlocking formation 18 engages the central-locking element pin 15 so that the central-locking element 8 if necessary assisted by engagement of the elements 16 and 17, moves into the position ENT.

The second actuation of the inside door handle 3 is different. Here the inside latching lever 5 also has a no-load stroke because the central-locking pin 15 is in position ENT and thus lies outside the arcuate path K2, that is clear of the unlocking formation 18. The latch mechanism according to FIG. 3 which also is in the position ENT is released so that the latch is opened.

In order to lock in the direction VER only a single actuation of the inside door handle 3 is needed, namely the latching stroke. For this the locking formation 19 presses the central-locking pin 15 from the position ENT into the position VER. A no-load path $F_2$ is also traversed since closing of the door is effected by the vehicle user who closes the door.

As a result of the free path $F_1$ between the unlocking formation 18 and the central-locking lever 15 in the position VER, it is certain that the central-locking pin 15 does not engage against the unlocking formation 18 when the central-locking element 8 and thus the central-locking pin 15 are pivoted into the position DS.

In the case that the illustrated motor-vehicle door latch is set in the "antitheft" or "antitheft-set" position DS, neither the unlocking formation 18 nor the locking formation 19 can engage the central-locking pin 15, since the central-locking pin 15 lies outside the paths of the two formations 18 and 19 of the inside latching lever 5 and thus are offset from the formation paths K1 and K2. As a result in this position the inside latching lever 5 and the central-locking lever 8 are uncoupled so that, even with the window broken in—the respective vehicle door cannot be opened.

What is claimed is:

1. A motor-vehicle door latch comprising:

a pivotal latch member;

a pawl operable to hold and release the latch member;

an actuating system;

a latching lever coupled to the actuating system and having an unlocking formation and a locking formation;

a one-piece central-locking element between the latching lever and the pawl and pivotal about an element axis between a locked position, an unlocked position, and an antitheft position, the central-locking element being formed with radially outwardly open first and second adjacent fork seats and having a central-locking pin that assumes together with the central-locking element the unlocked, locked, and antitheft positions, the latching lever cooperating with the central-locking element in the unlocked and locked positions, the unlocking formation and the locking formations moving on pivoting of the latching lever through respective arcs about a pivot axis of the latching lever and the central-locking pin describing on pivoting of the central-locking element about the element axis a pin arc, the arcs of the formations crossing the pin arc while the arcs of the formations are spaced in the antitheft position from the central-locking pin; and drive means having a drive pin movable along an arcuate path and engageable in the fork seats for displacing the central-locking element between the locked, unlocked, and antitheft positions, the unlocking formation being effective on the central-locking element for moving the central-locking element into the locked position and the locking formation on the central-locking pin for moving the central-locking element into the locked position.

2. The motor-vehicle door latch according to claim 1 wherein the fork seats are formed on a common arc of an arcuate segment of the central-locking element.

3. The motor-vehicle door latch according to claim 2 wherein the fork seats form four control surfaces.

4. The motor-vehicle door latch according to claim 1 wherein the element axis of the central-locking element and the pivot axis of the latching lever are parallel to each other, the central-locking element and the latching lever lying in separate planes and partially overlapping each other.

5. The motor-vehicle door latch according to claim 4 wherein the latching lever assumes after each actuation a spring-supported rest position.

6. The motor-vehicle door latch according to claim 5 wherein the latching lever is connected by means of a link with an inside door handle.

7. The motor-vehicle door latch according to claim 6 wherein locking and unlatching of the motor-vehicle door latch require a double actuation of the door handle.

8. The motor-vehicle door latch according to claim 6 wherein the link is an actuation rod or Bowden cable.

* * * * *